US006048446A

United States Patent [19]

Michaelis

[11] Patent Number: 6,048,446

[45] Date of Patent: Apr. 11, 2000

[54] METHODS AND APPARATUSES FOR ENGRAVING GRAVURE CYLINDERS

[75] Inventor: A. John Michaelis, Glen Ellyn, Ill.

[73] Assignee: R.R. Donnelley & Sons Company, Chicago, Ill.

[21] Appl. No.: 09/175,387

[22] Filed: Oct. 20, 1998

Related U.S. Application Data

[60] Provisional application No. 60/063,172, Oct. 24, 1997.

[51] Int. Cl.[7] ..... B41C 3/08; C25D 5/48; C25D 7/00; B05D 1/32; B05D 5/00

[52] U.S. Cl. ..... 205/127; 205/221; 205/921; 427/272; 427/282; 427/259; 427/270

[58] Field of Search ..... 205/127, 221, 205/921; 427/272, 282, 259, 270

[56] References Cited

U.S. PATENT DOCUMENTS

| | | | |
|---|---|---|---|
| 2,776,256 | 1/1957 | Eulner et al. | 204/25 |
| 3,636,251 | 1/1972 | Daly et al. | 178/6.6 B |
| 3,660,252 | 5/1972 | Glori | 204/17 |
| 3,923,610 | 12/1975 | Bergin et al. | 204/32 R |
| 3,947,330 | 3/1976 | Heidenberger | 204/17 |
| 3,985,953 | 10/1976 | Dunkley | 178/6.6 B |
| 4,003,311 | 1/1977 | Bardin | 101/426 |
| 4,158,567 | 6/1979 | Honma | 96/36.3 |
| 4,334,966 | 6/1982 | Beach et al. | 204/25 |
| 4,352,727 | 10/1982 | Metzger | 204/212 |
| 4,381,982 | 5/1983 | Metzger | 204/212 |
| 4,388,865 | 6/1983 | Kellner | 101/401.1 |

(List continued on next page.)

FOREIGN PATENT DOCUMENTS

| | | |
|---|---|---|
| 394 700 A2 | 10/1990 | European Pat. Off. . |
| 400 621 A2 | 12/1990 | European Pat. Off. . |
| 400621 | 12/1990 | European Pat. Off. . |
| 0728 578A1 | 8/1996 | European Pat. Off. . |
| 2054833 | 5/1972 | Germany . |
| 1517714 | 7/1998 | United Kingdom . |
| WO 89/12256 | 12/1989 | WIPO . |
| 97/19816 | 6/1997 | WIPO . |
| WO 97/19816 | 6/1997 | WIPO . |

OTHER PUBLICATIONS

PCT International Search Report Mar. 24, 1999.

Dambrot, Stuart M., "Japanese Researchers Push Electron Holography; Rarely Used in this Country, the Technique could Become a Powerful Tool for High–Temperature Superconductivity Studies," *Science*, vol. 246, Oct. 6, 1989, p. 31.

Dickman, et al., "A Crystal–Clear View of the World's Tiny Wonders," *Business Week*, Nov. 3, 1986, p. 134.

Ito, et al., "Improvement of Focusing and Tracking Servos in Optical Disk Memory," *SPIE*, vol. 529, Optical Mass Data Storage, Jan. 22–24, 1985, pp. 145–149.

Ruzic, Neil P., "Technologies Emerged: Once and Future Themes of Industrial Research, Silver Yearbook," *Research and Development*, Jun. 1984, p. 276.

*Primary Examiner*—Kathryn Gorgos
*Assistant Examiner*—Edna Wong
*Attorney, Agent, or Firm*—Ronald B. Coolley; Jenkens & Gilchrist

[57] ABSTRACT

The present invention provides several methods for engraving gravure cylinders much more rapidly and at a higher resolution while, at the same time, reducing the engraving cost. The present invention employs a resist that is deposited onto the surface of a gravure cylinder. The resist is capable of being physically and/or chemically changed in response to being exposed to a form of actinic energy, such as a laser beam. The exposed areas of resist allow a material, such as chromium, to be plated onto the surface of the gravure cylinder to form walls that define cells therebetween. In use, the cells contain ink for printing the desired patterns of text and/or images.

22 Claims, 3 Drawing Sheets

U.S. PATENT DOCUMENTS

| | | | |
|---|---|---|---|
| 4,391,899 | 7/1983 | Suzuki | 430/307 |
| 4,504,354 | 3/1985 | George et al. | 156/639 |
| 4,877,480 | 10/1989 | Das | 156/635 |
| 4,912,824 | 4/1990 | Baran | 29/121.2 |
| 5,019,486 | 5/1991 | Takakura | 430/307 |
| 5,023,166 | 6/1991 | Takakura | 430/307 |
| 5,029,011 | 7/1991 | Fraser | 358/299 |
| 5,164,285 | 11/1992 | Takakura | 430/307 |
| 5,205,212 | 4/1993 | Wolfe | 101/170 |
| 5,229,861 | 7/1993 | Nozaka et al. | 358/299 |
| 5,278,027 | 1/1994 | Clarke | 430/307 |
| 5,338,627 | 8/1994 | Shigeta | 430/6 |
| 5,402,246 | 3/1995 | Seitz et al. | 358/299 |
| 5,422,958 | 6/1995 | Wouch et al. | 382/141 |
| 5,424,845 | 6/1995 | Holowko et al. | 358/299 |
| 5,438,422 | 8/1995 | Holowko et al. | 358/299 |
| 5,440,398 | 8/1995 | Holowko et al. | 358/299 |
| 5,493,971 | 2/1996 | Lewis et al. | 101/454 |
| 5,519,502 | 5/1996 | Beckett | 358/299 |
| 5,555,473 | 9/1996 | Seitz et al. | 358/299 |
| 5,569,003 | 10/1996 | Goldman et al. | 409/132 |
| 5,617,217 | 4/1997 | Brewer et al. | 358/299 |
| 5,621,533 | 4/1997 | Holowko et al. | 358/299 |
| 5,663,801 | 9/1997 | Hada et al. | 358/299 |
| 5,663,802 | 9/1997 | Beckett et al. | 358/299 |
| 5,663,803 | 9/1997 | Beckett et al. | 358/299 |
| 5,675,420 | 10/1997 | Beckett et al. | 358/299 |
| 5,818,605 | 10/1998 | Crewe et al. | 358/299 |

METHODS AND APPARATUSES FOR ENGRAVING GRAVURE CYLINDERS

CROSS-REFERENCE TO RELATED APPLICATIONS

This application claims the benefit of Provisional Patent Application Ser. No. 60/063,172 filed Oct. 24, 1997, now abandoned, entitled "Methods and Apparatus for Engraving Gravure Cylinders".

FIELD OF THE INVENTION

The present invention is related to engraving gravure cylinders, more specifically, the present invention uses a novel combination of imaging and plating to create the desired patterns of text and/or images on gravure cylinders for use in gravure cylinder printing.

BACKGROUND OF THE INVENTION

Presently, gravure cylinder printing technology is used extensively in the printing industry for high quality, high volume printing applications. Gravure cylinder printing employs a printing press loaded with one or more gravure cylinders, each engraved with text and/or images. Gravure cylinders have been engraved with an engraving head of a machine such as a Helio-Klischograph manufactured by Dr. Ing. Rudolf Hell GmbH. The engraving head of the Helio-Klischograph uses a diamond stylus to create small depressions known as cells in the surface of the gravure cylinder. During this process, cells are engraved into the gravure cylinder in patterns forming the text and/or images to be printed. Once a gravure cylinder has been engraved as desired, it is loaded into the printing press. In order to print, the outer surface of an engraved gravure cylinder is coated with ink. Excess ink, that is, ink not contained by the cells, is removed with a doctor blade, thus preventing ink from being deposited onto what is intended to be a non-printing area.

Although it is desirable to make improvements in gravure cylinder printing, unfortunately, improvements in the gravure cylinder printing process are significantly constrained by the current limited ability to quickly produce high quality engraved cylinders. Present methods of engraving gravure cylinders, such as employing the Helio-Klischograph mentioned above, are relatively slow and time-consuming. Furthermore, in order to produce higher quality printing, greater resolution is required. Unfortunately, to achieve high resolution (greater cell density) with the Helio-Klischograph, even more time is required to fully engrave the gravure cylinder to engrave the additional cells. Moreover, even if the engraver has the luxury of time, cell density is limited by inherent mechanical aspects of the Helio-Klischograph technique which require the machine to control cell size and spacing while the engraving stylus is being moved over the surface of the gravure cylinder. Accordingly, it would be desirable to be able to much more rapidly engrave gravure cylinders. It would also be desirable to be able to engrave gravure cylinders at a much greater resolution than current methods practically allow. Furthermore, it would be desirable to be able to engrave gravure cylinders at a high resolution without paying a significant speed penalty.

Faster imaging of gravure cylinders would increase the throughput of an existing gravure cylinder facility by providing more cylinders in a given time. The additional throughput would enable existing facilities to meet the growing demand for shorter runs.

SUMMARY OF THE INVENTION

The present invention overcomes the described limitations of mechanically engraved gravure cylinders by employing methods and apparatuses for engraving gravure cylinders much more rapidly and at a higher resolution while, at the same time, reducing the engraving cost. The embodiments described herein employ a resist that is deposited onto the surface of a gravure cylinder. The resist is capable of being physically and/or chemically changed in response to being exposed to a form of actinic energy, such as a laser beam. The exposed areas of resist allow a material, such as chromium, to be plated onto the surface of the gravure cylinder to form walls that define cells therebetween. In use, the cells contain ink for printing the desired patterns of text and/or images.

One embodiment of the present invention uses a plate-up apparatus and method. In this embodiment, the gravure cylinder substrate is coated with a thin layer of thermally-sensitive, electrically-insulating resist. Portions of the resist coating are exposed to a laser which forms patterns in the resist corresponding to the text and/or images ultimately desired. Either the exposed or unexposed portions of the resist are removed, depending on whether a positive or negative resist is employed, exposing an outer nickel surface of the gravure cylinder. The cylinder is then placed into an electroplating bath. An electrical current is passed between an electrode containing chromium and the gravure cylinder, causing the chromium to be plated onto the electrically conductive portions of the surface of the gravure cylinder, that is, the chromium is attracted and adheres to the exposed areas of the nickel on the gravure cylinder and not to the areas still covered by the electrically insulating resist. The amount of chromium plated onto the exposed portions of the cylinder is determined by controlling the amount and duration of the electrical current allowed to flow in the electroplating bath. The chromium plated onto the gravure cylinder is plated up to a desired thickness to form chromium walls that define cells therebetween.

Another embodiment of the present invention uses an electroform plate-up apparatus and method. In this embodiment, the gravure cylinder substrate is coated with a thick layer of thermally-sensitive, electrically-insulating, resist. The thickness of the resist is sufficient to remain in contact with the chromium walls as they are plated up from the gravure cylinder. In one embodiment, a conical laser beam is used to create substantially trapezoidal-shaped areas in the resist coating. As in the previously recited method, the resist layer is exposed to a laser which forms the patterns in the resist corresponding to the text and/or images ultimately desired. The exposed portions of the resist are removed, revealing the outer nickel surface of the gravure cylinder. The cylinder is then placed into the electroplating bath. An electrical current is passed between an electrode containing chromium and the gravure cylinder, causing the chromium to be plated onto the exposed portions of the gravure cylinder. The chromium plated onto the gravure cylinder is plated up to the desired thickness to form the chromium walls. The remaining resist is then removed to expose the desired pattern of cells.

Still another embodiment uses a reverse plating apparatus and method. In this embodiment, the gravure cylinder substrate is placed into the electroplating bath. An electrical current causes the cylinder to be plated with chromium up to its desired height above the cylinder to form a plated chromium layer. Next, a thin layer of thermally-sensitive, electrically-insulating resist is applied over the plated chromium layer. Portions of the resist coating are exposed to a laser which forms the patterns in the resist corresponding to the text and/or images ultimately desired. Either the exposed or unexposed portions of the resist are removed, depending on whether a positive or negative resist is employed, exposing the plated chromium layer. The cylinder is then again placed into the electroplating bath, however, the electrical current is reversed and chromium is removed from the plated chromium layer and is deposited back onto the chromium containing electrode. The amount of electrical current passed between the chromium containing electrode and the chromium containing layer is carefully controlled to remove the correct amount of chromium. Alternatively, the chromium can be removed until the underlying nickel layer of the gravure cylinder is exposed, thus allowing the nickel layer to act as an etch-stop, preventing additional etching directed into the gravure cylinder. The efficacy of the etch-stop may be further enhanced by electroplating the nickel layer with a layer of a noble metal such as rhodium or gold. The noble metal will be less inclined to be affected by the reverse plating current.

All of the methods require removal of the walls after printing. This may be performed by placing the cylinder in a plating bath and reverse plating the walls back onto the plating electrodes, using the dissimilar underlying layer, e.g., nickel, as an etch stop. Removal of the walls may also be achieved by other forms of etching including plasma etching, where the underlying layer may act as an etch stop. The walls may also be removed by grinding or other forms of machining.

The present invention eliminates a number of problems and offers significant advantages when compared with present mechanical engravers. For example, by using a commercially available laser engraving head containing an 830 nm (nanometer) infrared laser (thermal laser), such as those available in the Trendsetter system from Creo Corporation, 3700 Gilmore Way, Burnaby, British Columbia, Canada, the resist can be patterned (imaged) far faster than commercially available mechanical engraving heads. The thermal laser is used to expose and pattern the resist approximately thirty times faster than a standard engraving head employed in a Helio-Klischograph. Furthermore, one or more thermal laser heads could be mounted on an existing Helio-Klischograph in place of the head containing the diamond engraving stylus. This enormous improvement in speed does not negatively affect print quality. In fact, significantly higher resolution is achieved with the present invention. Moreover, the increase in resolution is nearly independent of the speed at which the gravure cylinder is engraved. This allows the present invention to overcome the limitation of prior engraving systems, i.e., increasing the print resolution required increasing the time required to form the desired patterns on the gravure cylinder.

BRIEF DESCRIPTION OF THE DRAWINGS

Other objects and advantages of the invention will become apparent upon reading the following detailed description in conjunction with the drawings.

DESCRIPTION OF ILLUSTRATIVE EMBODIMENTS

Figure 1:
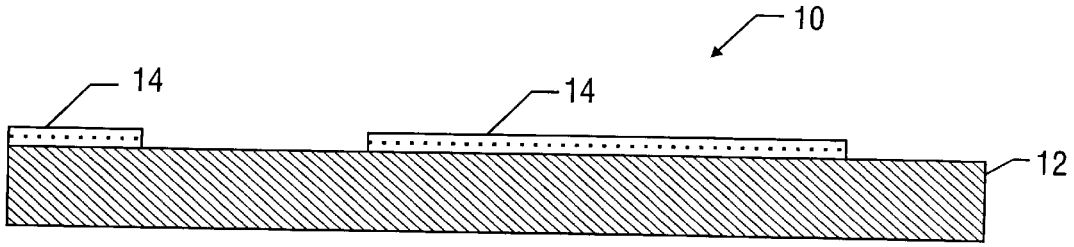
FIG. 1 is a two-dimensional side view of a portion of a gravure cylinder showing a patterned resist having some areas of the resist removed from said gravure cylinder to expose portions of the gravure cylinder in accordance with the plate-up method and apparatus.

While the invention is susceptible to various modifications and alternative forms, a number of specific embodiments thereof have been shown by way of example in the drawings and will be described in detail herein. It should be understood, however, that this is not intended to limit the invention to the particular forms disclosed. On the contrary, the intention is to cover all modifications, equivalents and alternatives falling within the spirit and scope of the invention as defined by the appended claims.

The present invention patterns (images) the resist far faster than commercially available mechanical engraving heads by employing some type of actinic energy, such as a focused visible light, an electron beam or a laser beam, to change the resist, for example, chemically, physically or by ablation or obliteration, i.e., the resist is changed and removed in one step, by exposing the resist to that form of actinic energy. One commercially available laser engraving head, containing an 830 nm (nanometer) conical infrared laser (thermal laser), is available in the Trendsetter system from Creo Corporation, 3700 Gilmore Way, Burnaby, British Columbia, Canada. Laser thermal imaging may be used to produce exposed and unexposed areas in a resist layer for the plate-up method, the electroform plate-up method and the reverse plating method described herein. Alternatively, other methods or combinations of methods can be used to create the exposed and unexposed areas, depending on the resists employed, such as any type of actinic energy including particle beams, electromagnetic radiation, and infrared laser beams.

These three methods can be configured for use with Ballard-Shell technology which enables one to use mechanical means to strip the old image off a gravure cylinder in order to form another image.

Figure 2:
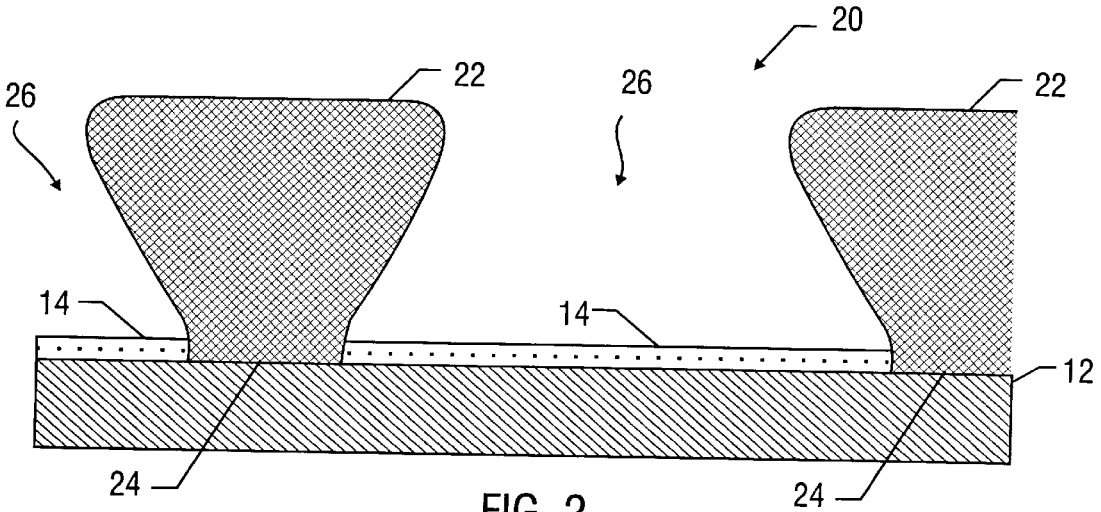
FIG. 2 is a two-dimensional side view of a portion of the gravure cylinder of FIG. 1 showing the chromium plated-up to form walls that define a cell.

Referring now to FIGS. 1 and 2, the plate-up apparatus and method are described. More specifically, FIG. 1 illustrates a portion of a partially patterned or developed gravure cylinder 10. Only a portion of the outer surface 12 of a gravure cylinder 10 is shown. In one embodiment, the portion of the outer surface 12 of the gravure cylinder 10 is made of nickel, although other materials such as copper can be used. The surface of the gravure cylinder 10 is coated with a thermally-sensitive, electrically-insulating resist 14. In accordance with the present invention described herein, any suitable method for depositing the resist can be employed. For example, the resist may be sprayed onto the cylinder, or applied by dip coating or sputtering. The resist 14 is deposited to a thickness of approximately 1 μm (micrometer) in order to provide sufficient electrical insulation. The resist 14 is patterned (imaged) at high resolution, for example, 2540 dpi (dots per inch) with, for example, a thermal laser (not shown). This is accomplished by exposing some areas of the resist to, for example, a laser, but not other areas, in accordance with the pattern of text and/or images desired. The action of the laser may directly cause the removal of the resist or the resist may be removed chemically, mechanically or otherwise. Either the exposed areas or the unexposed areas are removed, but not both. Whether the exposed areas or the unexposed areas are removed depends on whether a positive or negative resist is used and on the method used to remove that area. In one embodiment, a chemical agent, such as an alkaline solution, is used to remove either the exposed or unexposed areas of the resist depending on whether a positive or negative resist is used. The resist is shown in FIG. 1 having some areas removed while other areas remain on the nickel substrate 12. Thus, the resist 14 is the remaining resist. The resist 14 illustrated in FIG. 1 is referred to as developed or patterned.

Referring now to FIG. 2, an engraved gravure cylinder 20 is shown. The gravure cylinder 10 shown in FIG. 1 has been patterned and placed into an electroplating chromium bath (not shown). In the electroplating bath, an electrical current is passed between an electrode containing chromium and the exposed, electrically conductive areas of the gravure cylinder 10 to form chromium walls 22. By means understood in the relevant arts, the chromium is attracted to the exposed, conductive nickel on the gravure cylinder 10, thereby selectively plating chromium onto the cylinder to produce a finished gravure cylinder 20. If desired, the remaining resist can be chemically, mechanically or otherwise removed, such as by a solvent in a solvent-based ink, such as toluene. The constraints imposed by the thick resist produces the substantially trapezoidal-shaped chromium walls 22 shown in FIG. 2. The areas between the chromium walls form the cells 26 that contain the ink for printing the desired patterns of text and/or images. Depending on the particular printing application desired, a possible physical weakness between the chromium base portion 24 of the chromium walls 22 and the nickel substrate 12 is reduced by the electroform plate-up method described below.

Figure 3:
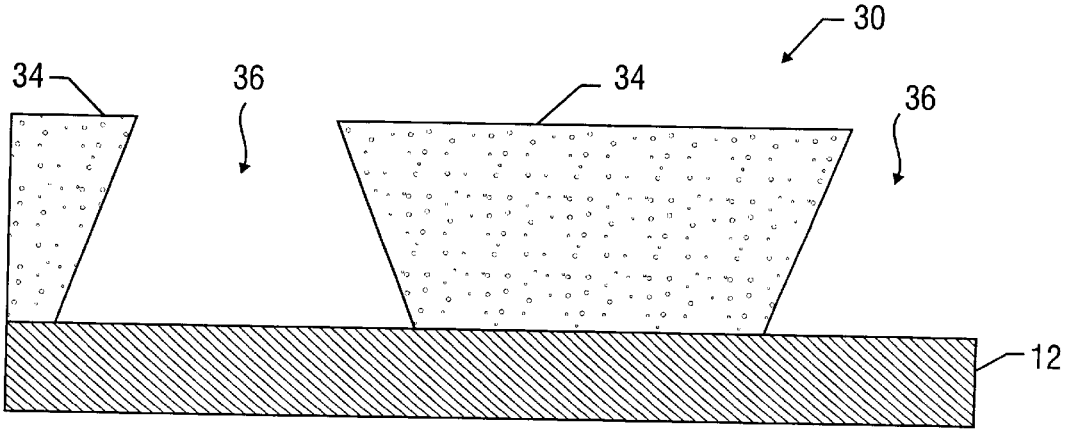
FIG. 3 is a two-dimensional side view of a portion of a gravure cylinder showing the patterned resist having some areas of the resist removed in accordance with the electroform plate-up method and apparatus.
Figure 4:
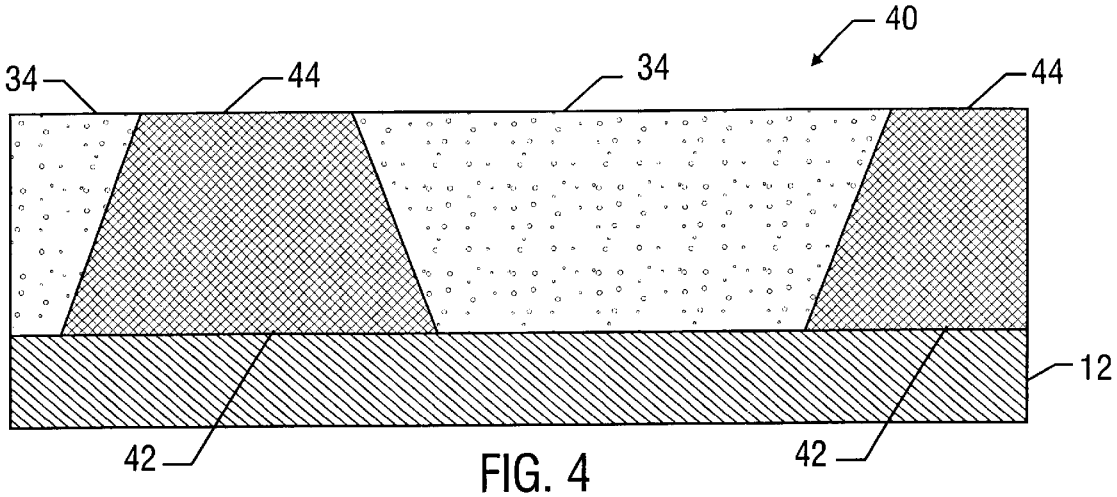
FIG. 4 is a two-dimensional side view of a portion of the gravure cylinder of FIG. 3 showing the chromium plated-up to the top of the resist prior to removal of the resist.
Figure 5:
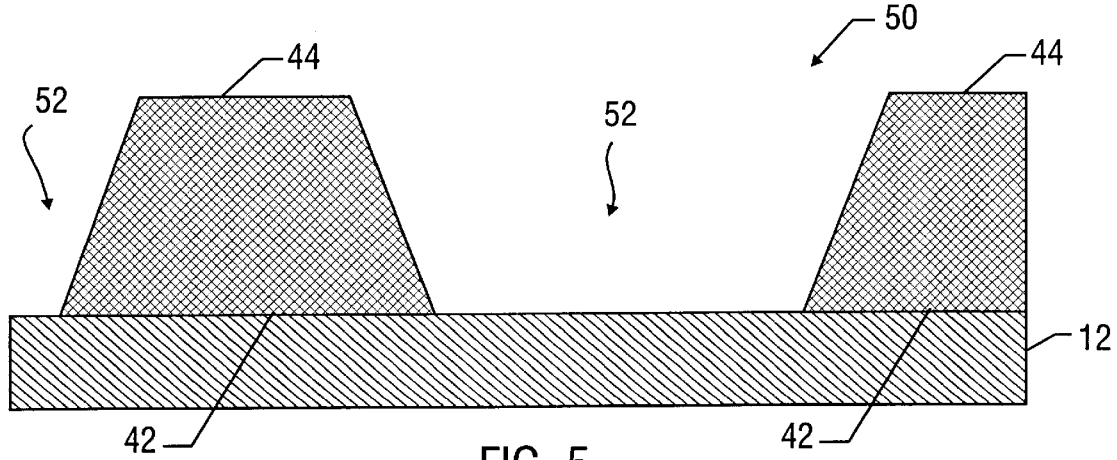
FIG. 5 is a two-dimensional side view of a portion of the gravure cylinder of FIG. 3 showing the chromium walls subsequent to the removal of the resist.

Referring now to FIGS. 3, 4 and 5, the electroform plate-up apparatus and method are described. More specifically, FIG. 3 illustrates a portion of a partially patterned or developed gravure cylinder 30. Only a portion of the outer surface 12 of a gravure cylinder 30 is shown. In one embodiment, the portion of the outer surface 12 of the gravure cylinder 30 is made of nickel, although other materials such as copper can be used. The surface of the gravure cylinder 30 is coated with a thick layer of thermally-sensitive, electrically-insulating resist 34. The resist 34 is coated to a thickness greater than or equal to the desired height of the chromium walls to be formed. Of course, one will recognize that even thicker layers of resist will achieve essentially the same effect of constraining the shape of plated chromium. The resist 34 is patterned (imaged) at high resolution, for example, 2540 dpi with, for example, the beam of a laser, such as the 830 nm conical infrared laser (thermal laser), described above. This is accomplished by exposing predetermined areas of the resist 34 to, for example, the beam of a laser. A defocused (conical) laser beam will produce exposed areas 36, each having a substantially trapezoidal-shaped profile, as illustrated in FIG. 3. FIG. 3 shows the exposed areas of the resist 36 as being removed while the unexposed areas of the resist 34 remain attached to the outer surface 12 of the gravure cylinder 30.

Referring now to FIG. 4, the gravure cylinder 30, as shown in FIG. 3, is placed into an electroplating chromium bath, such as the one described above. In the electroplating bath, an electrical current is passed between an electrode containing chromium and the uncovered electrically conductive areas 42 of the gravure cylinder 40 corresponding to the exposed areas 36 of the resist 34 in FIG. 3, to form chromium walls 44. By accurately controlling the amount and duration of the electrical current passed through the chromium containing electrode, the amount of chromium plated onto the gravure cylinder 12 may be precisely controlled. The constraints imposed by the thick resist produces the substantially trapezoidal-shaped chromium walls 44 shown in FIG. 4. Chromium is plated-up using the resist as a guide to form a wide stable base. Depending on the particular printing application desired, the possibility of a possible physical weakness between the chromium base portion 42 of the chromium walls 44 and the nickel substrate 12 of the gravure cylinder 40 is reduced by the electroform plate-up method. The remaining resist is chemically, mechanically or otherwise removed to form the open cells 52, as illustrated in FIG. 5. FIG. 5 shows the finished gravure cylinder 50 produced according to the electroform plate-up method of the present invention.

Figure 6:
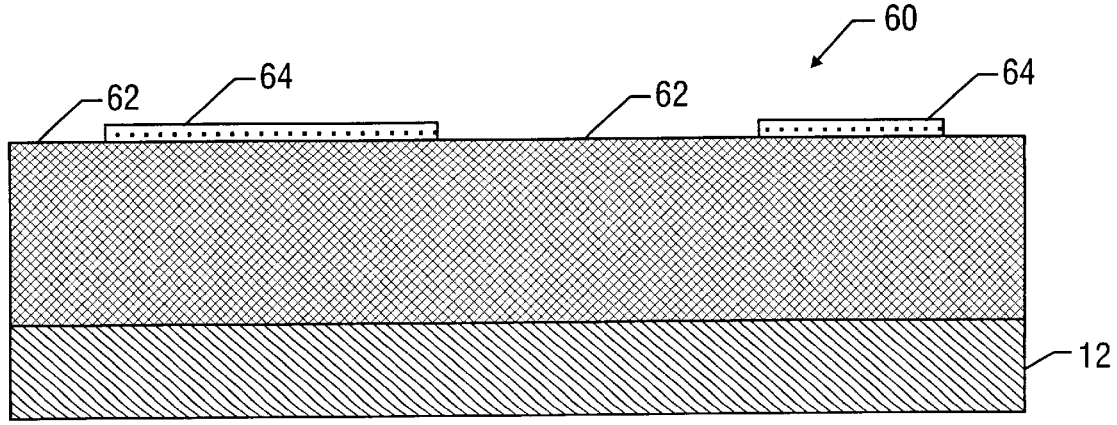
FIG. 6 is a two-dimensional side view of a portion of a gravure cylinder showing a plated chromium layer below a patterned resist having some areas of the resist removed in accordance with the reverse plating method and apparatus.
Figure 7:
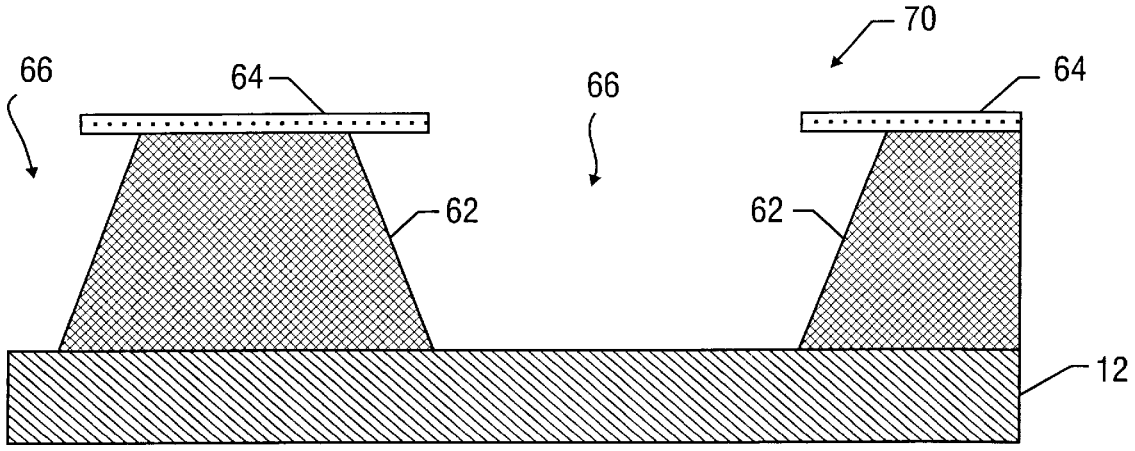
FIG. 7 is a two-dimensional side view of a portion of the gravure cylinder of FIG. 6 showing the plated chromium layer partially removed below the patterned resist.

Referring now to FIGS. 6 and 7, the reverse plating apparatus and method are described. More specifically, FIG. 6 illustrates a portion of a partially patterned or developed gravure cylinder 60. Only a portion of the outer surface 12 of a gravure cylinder 60 is shown. In one embodiment, the portion of the outer surface 12 of the gravure cylinder 60 is made of nickel, although other materials such as copper can be used. A chromium layer 62 is plated onto the surface of the gravure cylinder 60 in an electroplating bath, such as the one described above, to the desired final thickness. A thin layer of thermally-sensitive, electrically-insulating resist 64 is deposited over the chromium layer 62. The resist 64 coating is patterned (imaged) at high resolution, for example, 2540 dpi with, for example, the beam of a laser, such as the 830 nm infrared laser (thermal laser), described above. This is accomplished by exposing some areas of the resist to, for example, a laser, but not other areas, in accordance with the pattern of text and/or images desired, then chemically, mechanically or otherwise removing either the exposed areas or the unexposed areas, but not both. Whether the exposed areas or the unexposed areas are removed depends on the type of resist used and the method used to remove that area. Note that resist 64 may be the type of resist that is removed or the type of resist that is not removed. The resist 64 is shown in FIG. 6 having some areas removed while others remain on the nickel substrate 12. Thus, the resist 64 on the gravure cylinder 60 is developed or patterned.

Turning now to FIG. 7, after the resist 64 has been patterned, the gravure cylinder 70 is placed into an electroplating bath, such as the one described above. At this point the polarity of the electrical current is reversed, causing chromium to be removed from the areas corresponding to the areas where the resist 64 was removed and returned back to the chromium containing electrode. This reverse plating process will undercut the resist to produce substantially trapezoidal-shaped areas because the top of the chromium layer 62 experiences a longer exposure time to the reverse plating effect than does the bottom of the chromium layer 62. As an alternative to reverse plating, an etching process can be used. The dissimilar material of the substrate, e.g., nickel, provides a solid etch-stop, to ensure accurate cell depths. Reverse plating does, however, have the advantage that it is environmentally clean and conserves valuable chromium. The removal of the resist 64 completes the gravure cylinder 70, leaving the open areas to act as cells 66 for receiving the ink used for printing the desired patterns of text and/or images.

After printing, the patterns of text and/or images are removed by additional reverse chromium plating. In this way, the cylinder is already in the chromium plating bath and ready for the next plate-up operation.

In the three methods described herein, the resulting cells include a surface for the doctor blade to ride on. When the printing run is completed, reverse plating (plating from the cylinder back to the chromium electrode by reversing the polarity) will remove the chromium from the cylinder and prepare the cylinder surface for a new image. This is an alternate to the Ballard-Shell approach. The gravure cylinder is placed back in the chromium-plating tank, and the polarity of the electrical current is reversed, as in the reverse plating method described above, to return the chromium back to the chromium electrode.

The present invention offers multiple advantages over existing mechanical engraving. The present invention engraves a gravure cylinder approximately 30 times faster than one existing Helio-Klischograph while achieving a higher print resolution. Furthermore, the elimination of having to setup the diamond stylus and having to perform test cuts will save time and labor. The present invention will not be affected by variations in the mechanical engravability of copper, because copper is not being mechanically manipulated as in the Helio-Klischograph, therefore, consistency is improved.

Materials other than chromium and/or nickel may be used to form the outer surface and/or the walls. Additionally, more than one material may be used to form the walls. For example, the walls may be comprised of chromium, chromium-nickel and/or nickel. Alternatively, a nickel or copper wall may be finished (coated) with, for example, a chromium or chromium-alloy layer to provide a hard and durable surface. Also, alternative methods to plating may be used to deposit and remove the layers of material, including vacuum deposition, CVSD, plasma etching and grinding.

While the present invention has been described with reference to one or more particular embodiments, those skilled in the art will recognize that many changes may be made thereto without departing from the spirit and scope of the present invention, which is set forth in the following claims, therefor only such limitations should be imposed as are indicated by the appended claims.

What is claimed is:

1. A method for engraving a gravure cylinder, comprising:

depositing a layer of resist onto the gravure cylinder;

forming a pattern of first areas and second areas in said layer of resist; and depositing a sufficient amount of at least one wall-forming material selected from the group consisting of metal and metal-alloy onto exposed areas of said gravure cylinder to form walls capable of holding a sufficient amount of ink to form an image on a media.

2. The method of claim 1, further including the step of removing a remaining portion of said resist to produce said exposed areas of said gravure cylinder.

3. The method of claim 1, wherein said walls define a plurality of cells therebetween.

4. The method of claim 1, wherein said pattern of first areas and second areas are formed by exposing said first areas or said second areas to a laser beam.

5. The method of claim 1, wherein said pattern of first areas and second areas are formed by exposing said first areas or said second areas to a form of actinic energy.

6. The method of claim 1, further including the step of removing said wall-forming material until an underlying layer of the gravure cylinder is exposed, said underlying layer acting as an etch-stop.

7. The method of claim 1, wherein said walls have a generally trapezoidal-shaped profile.

8. The method of claim 1, further including depositing a layer of a second wall-forming material selected from the group consisting of chromium, nickel, chromium-nickel, chromium-alloy and copper onto said gravure cylinder.

9. The method of claim 1, wherein said wall-forming material is primarily comprised of a material selected from the group consisting of chromium, chromium-nickel and nickel.

10. The method of claim 1, wherein said wall-forming material includes an outer surface formed primarily of a material selected from the group consisting of chromium and chromium-alloy.

11. The method of claim 1, wherein said wall-forming material is deposited onto said gravure cylinder by plating.

12. The method of claim 1, wherein said metal is chromium, nickel, chromium-nickel, or copper, and wherein said metal-alloy is chromium-alloy.

13. A method for engraving a gravure cylinder, comprising:

depositing a layer of a wall-forming material selected from the group consisting of metal and metal-alloy onto said gravure cylinder;

depositing a layer of resist onto said layer of wall-forming material;

forming a pattern of first areas and second areas in said layer of resist;

removing said first areas to produce exposed areas of said layer of said wall-forming material;

removing a portion of said layer of said wall-forming material adjacent to said exposed areas until an underlying layer of the gravure cylinder is exposed, said underlying layer acting as an etch-stop, the removed portion exposing parts of said gravure cylinder roughly corresponding to said exposed areas.

14. The method of claim 13, wherein said pattern of first areas and second areas are formed by exposing said first areas or said second areas to a laser beam.

15. The method of claim 13, wherein said pattern of first areas and second areas are formed by exposing said first areas or said second areas to a form of actinic energy.

16. The method of claim 13, further including the step of placing said gravure cylinder into an electroplating bath and setting the polarity of an electrical current to cause said portion of said wall-forming material adjacent to said exposed areas to be removed.

17. The method of claim 13, wherein said wall forming material forms walls having a generally trapezoidal-shaped profile.

18. The method of claim 13, further including depositing a layer of a second wall-forming material selected from the group consisting of chromium, nickel, chromium-alloy and copper onto said gravure cylinder.

19. The method of claim 13, wherein said wall-forming material is primarily comprised of a material selected from the group consisting of chromium, chromium-nickel and nickel.

20. The method of claim 13, wherein said wall-forming material includes an outer surface formed primarily of a material selected from the group consisting of chromium and chromium-alloy.

21. The method of claim 13, wherein said wall-forming material is deposited onto said gravure cylinder by plating.

22. The method of claim 13, wherein said metal is chromium, nickel, chromium-nickel, or copper, and wherein said metal-alloy is chromium-alloy.

* * * * *